US005213261A

United States Patent [19]

Rosenberg

[11] Patent Number: 5,213,261

[45] Date of Patent: May 25, 1993

[54] ROTARY SPRINKLER

[76] Inventor: Peretz Rosenberg, Moshav Beit Sha'Arim, Israel

[21] Appl. No.: 863,887

[22] Filed: Apr. 6, 1992

[30] Foreign Application Priority Data

May 2, 1991 [IL] Israel ..... 98038

[51] Int. Cl.[5] ..... B05B 1/08; B05B 15/10

[52] U.S. Cl. ..... 239/99; 239/205; 239/241

[58] Field of Search ..... 239/99, 203-206, 239/237, 240, 241

[56] References Cited

U.S. PATENT DOCUMENTS 1,598,541 8/1926 Orr ..... 239/241 X 1,665,371 4/1928 Keys ..... 239/206

1,811,591 1/1930 Oehler ..... 239/241 X 1,815,395 7/1931 Buckner ..... 239/206

1,919,243 7/1933 Munz ..... 239/206

*Primary Examiner*—Andres Kashnikow

*Assistant Examiner*—Kevin P. Weldon

*Attorney, Agent, or Firm*—Benjamin J. Barish

[57] ABSTRACT

A rotary sprinkler includes a sprinkler head rotatably mounted about a rotary axis, and also mounted for reciprocation along its rotary axis; and a stepping mechanism for stepping the sprinkler head an increment of rotation during each reciprocation of the sprinkler head, such that each time the pressurized water is applied to the sprinkler head, it discharges the jet at a slightly different direction laterally of the sprinkler.

17 Claims, 2 Drawing Sheets

FIG 3
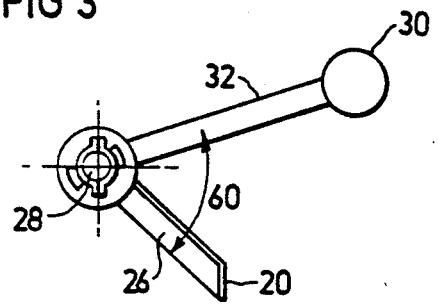
FIG 4
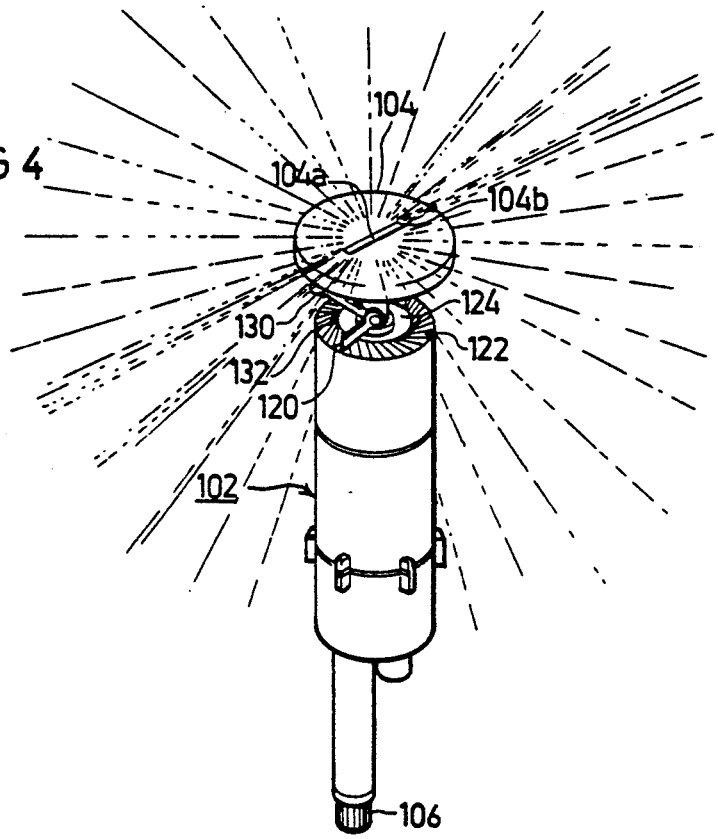
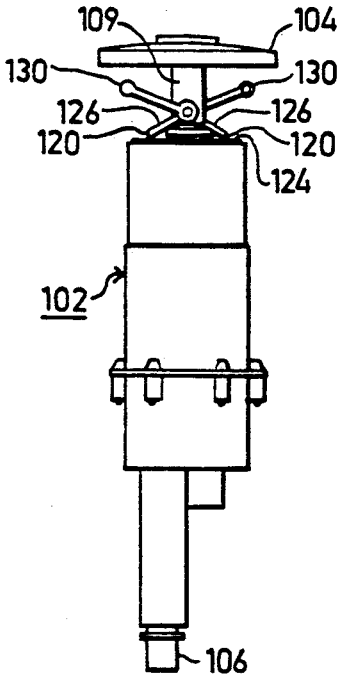
FIG 5

ROTARY SPRINKLER

FIELD AND BACKGROUND OF THE INVENTION

The present invention relates to rotary sprinklers for distributing water laterally of the sprinker.

The conventional rotary sprinkler is rotated continuously during the time pressurized water is supplied to the sprinkler and discharged therefrom in the form of a jet. However, the continuous rotation of a sprinkler decreases its range. It also increases water losses caused by wind dissipation and evaporation.

OBJECTS AND BRIEF SUMMARY OF THE INVENTION

An object of the present invention is to provide a rotary sprinkler having advantages in the above respects.

According to the present invention, there is provided a rotary sprinkler, comprising: a housing having an inlet connectable to a source of pressurized water, and an outlet; a sprinkler head rotatably mounted on said housing about a rotary axis, and connected to said housing outlet to receive pressurized water therefrom and to discharge the water in the form of at least one jet laterally of the sprinker; said sprinkler head also being mounted on the housing for reciprocation along said rotary axis in one direction, from a normal position to an extended position, by the application of the pressurized water thereto, and in the opposite direction, from the extended position back to the normal position, upon the discontinuation of the pressurized water thereto; and a stepping mechanism for steppping the sprinkler head an increment of rotation during each reciprocation of the sprinkler head, such that each time the pressurized water is applied to the sprinkler head, it discharges the jet at a slightly different direction laterally of the sprinkler.

It will thus be seen that a rotary sprinkler constructed in accordance with the foregoing features does not rotate continuously as it discharges the water: rather, it is stepped one increment of rotation only when the water discharge is stopped and restarted. Thus, it provides the benefits of a static sprinkler with respect to long range and reduced water losses, and the advantages of a rotary sprinkler with respect to capability of distributing the water around the sprinkler.

According to further features in the preferred embodiment of the invention described below, the stepping mechanism comprises an indexing pawl carried by the sprinkler head engagable with a circular array of ribs formed in a surface of the housing around said rotary axis to step the sprinkler head each time the sprinkler head moves back to its normal position upon discontinuation of the pressurized water thereto.

Two embodiments of the invention are described below for purposes of example.

According to one described embodiment, the sprinkler is a pop-up sprinkler in which the housing is buried in the ground with the sprinkler head normally positioned substantially at ground level and adapted to pop-up to a level above the ground upon the connection of the sprinkler head to the pressurized water.

According to the second described embodiment, the sprinkler is a pulsating-type sprinkler which applies pressurized water to the sprinkler head at time-spaced intervals, each application of pressurized water to the sprinkler head moving it to its extended position. The latter type sprinkler has been found particularly advantageous in minimizing the amount of water required for irrigation.

Further features and advantages of the invention will be apparent from the description below.

BRIEF DESCRIPTION OF THE DRAWINGS

The invention is herein described, by way of example only, with reference to the accompanying drawings, wherein:

FIG. 3 is a side elevational view illustrating the indexing pawl of the indexing mechanism in the pop-up sprinkler of FIG. 1;

and FIGS. 4 and 5 are perspective and side views, respectively illustrating the invention embodied in a pulsating-type sprinkler.

DESCRIPTION OF PREFERRED EMBODIMENTS

Figure 1:
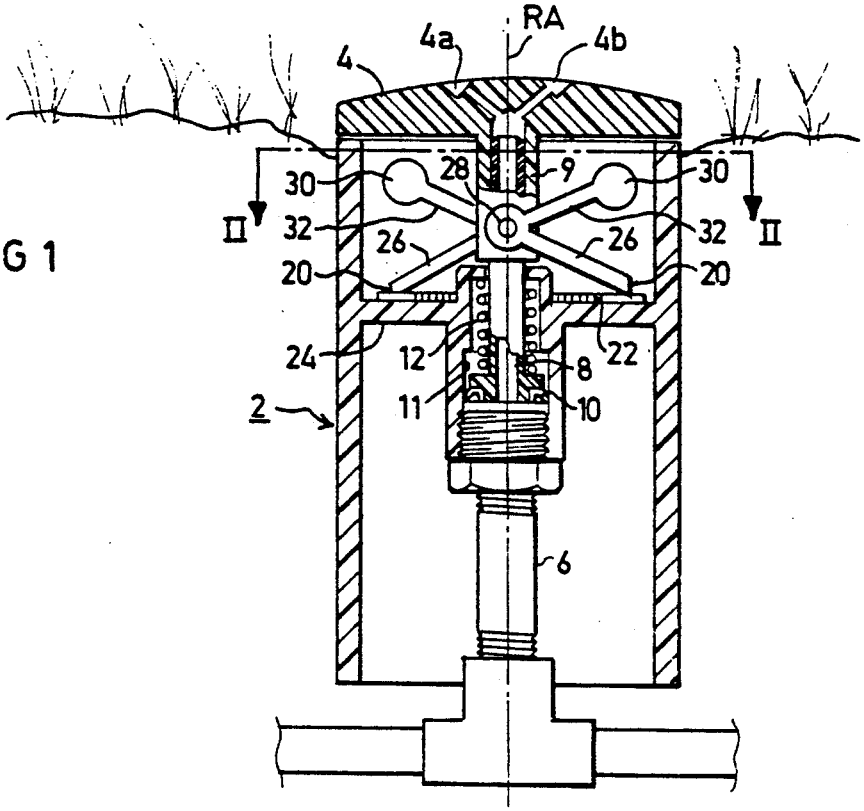
FIG. 1 is a sectional view illustrating a pop-up sprinkler constructed in accordance with the present invention.
Figure 2:
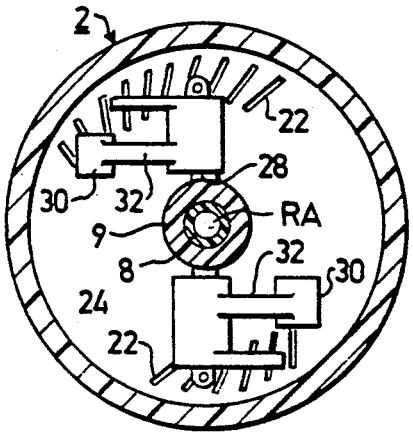
FIG. 2 is a sectional view along line II—II of FIG. 1.

The pop-up sprinkler illustrated in FIGS. 1–3 includes a housing 2 and a sprinkler head 4 rotatably mounted to the housing and carrying two diametrically-opposed nozzles 4*a*, 4*b*. The housing 2 is usually buried in the ground with the sprinkler head normally at ground level; when pressurized water is supplied to the sprinkler, the sprinkler head pops-up to a level above the ground and discharges the water in the form of jets via its two nozzles 4*a*, 4*b* laterally of the sprinkler.

Figure 1A:
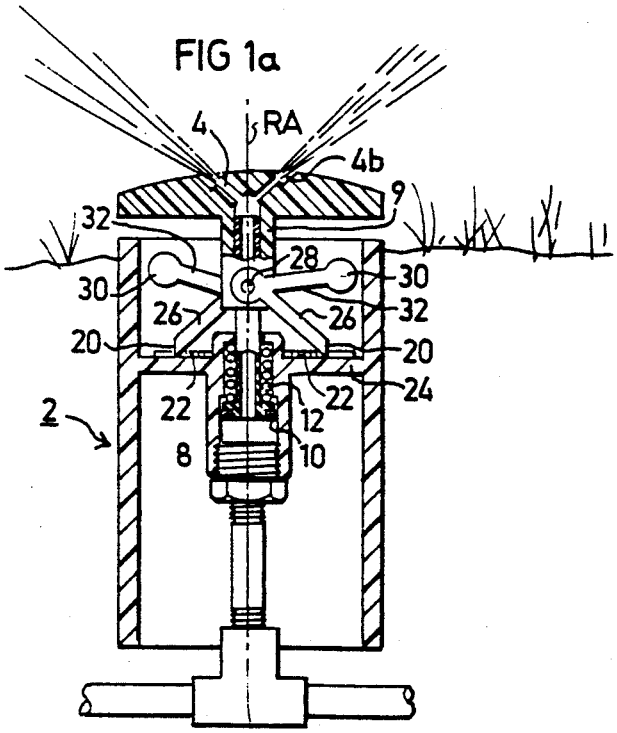
FIG. 1*a* illustrates the sprinkler of FIG. 1 in operating condition.

Housing 2 includes an inlet 6 connectable to a supply of pressurized water, and an outlet in the form of a hollow piston stem 8 slidably received within inlet stem 9 of the sprinkler head 4. Piston stem 8 includes a head 10 slidable within a cylindrical cavity 11 formed in the housing 2. A spring 12 normally biases the sprinkler head 4 to its retracted position within housing 2, as shown in FIG. 1. When pressurized water is applied to the inlet 6 of the sprinkler, the pressure of the water moves the sprinkler head 4 to its extended (outer) postiion (shown in FIG. 1*a*), at which position it discharges the water via the nozzles 4*a*, 4*b* in the form of jets. Upon the discontinuation of the supply of pressurized water to the sprinkler, spring 12 returns the sprinkler head 4 to its normal retracted position.

Hollow stem 10 of the sprinkler head 4, receivable over hollow stem 8 of the piston head 10, permits the sprinkler head also to rotate at the time it discharges the water jets. The rotation of the sprinkler head 4, however, is not continuous: rather, it is in the form of stepped increments. Thus, the sprinkler head is stepped one increment of rotation each time the water supply is discontinued and the sprinkler head returns to its normal retracted position, so that when the pressurized water is next applied to the sprinkler, the sprinkler head will be oriented to discharge the jets at a slightly different direction laterally of the sprinkler.

The mechanism for stepping the sprinkler head includes two indexing pawls 20 carried by the hollow stem 9 of the sprinkler head 4, engagable with a circular array of ribs 22 formed on an inner fixed surface 24 of housing 2. Indexing pawls 20 are carried at the free ends of arms 26 pivotal at their opposite ends about a horizontal pivot 28 on the sprinkler head stem 9, so that both arms 26 and their indexing pawls 20 move upwardly with the sprinkler head when moved to its extended position, and move downwardly when the sprinkler head is returned to its normal retracted position. Arms 26 are biased downwardly towards ribs 22 by means of weights 30 carried by other arms 32 fixed to arms 26 at pivot point 28.

The indexing ribs 22 formed on the fixed surface 24 of housing 2 are arranged in a circular array about the rotary axis RA of the sprinkler head 4. These ribs are configured and disposed such that when the sprinkler head 4 is moved to its extended position, indexing pawls 20 carried at the ends of pivotal arms 26 are moved by the downward pivoting of the arms to overlie the spaces between the next pair of ribs, so that when the sprinkler head 4 moves downwardly back to its normal position, upon the discontinuation of the supply of pressurized water to it, the downward movement of the indexing pawls will rotate the sprinkler head one increment of rotary movement. For example, if there are 72 ribs 22 formed in surface 24, each upward and downward reciprocation of the sprinkler head 4 will rotate the sprinkler head five degrees.

The pop-up sprinkler illustrated in FIGS. 1-3 operates as follows:

When pressurized water is not supplied to the inlet 6 of the sprinkler, the sprinkler head 4 is in its normal retracted position substantially at ground level by the bias of spring 12. In this position, indexing pawls 20 sit between a pair of the indexing ribs 22 formed in surface 24 of the sprinkler housing 2.

When pressurized water is supplied to inlet 6, the pressurized water is conducted via the hollow stems 8 and 9 to the sprinkler head 4 and to its two nozzles 4*a*, 4*b*. As soon as the pressurized water is supplied to the sprinkler, the pressure of the water moves the sprinkler head 4 upwardly above the ground level (FIG. 1*a*), and the water is discharged via the two nozzles 4*a*, 4*b* in the form of jets laterally of the sprinkler. The nozzles 4*a*, 4*b* are aligned with the rotational axis 2A of the sprinkler head so that there is no significant reaction force tending to rotate the sprinkler head 4.

As soon as the sprinkler head 4 rises to its extended position (FIG. 1*a*) by the pressurized water, it raises indexing pawls 20 out of contact with the fixed surface 24 of the sprinkler housing, whereupon weights 30 pivot arms 32 and 26 clockwise a slight distance to align the indexing pawls 20 with the spaces between the next pair of indexing ribs 22.

When the supply of pressurized water to the sprinkler head 4 is discontinued, spring 12 lowers the sprinkler head 4, and therefore also its hollow stem 9, to their normal retracted positions. Towards the end of the lowering movement of hollow stem 9, indexing pawls 20 are received in the spaces between the pair of indexing ribs 22 with which they had been previously aligned, so as to increment the sprinkler head 4 one increment of rotary movement at the completion of the return of the sprinkler head to its normal retracted position.

Thus, the next time pressurized water is supplied to the sprinkler, the two nozzles 4*a*, 4*b* of the sprinkler head 4 will have been moved to a slightly different direction than during the previous discharge of the sprinkler.

It will thus be seen that the pop-up sprinkler illustrated in FIGS. 1-3 acts as a static sprinkler while discharging water; that is, the water jets from the nozzles 4*a*, 4*b* are not rotated while discharging the water, but rather discharge the water while static, and therefore the water is discharged in a straight line. However, when the supply of pressurized water is discontinued, the retraction of the sprinkler head by spring 12 indexes the sprinkler head one rotatary increment, so that the next time pressurized water is supplied to the sprinkler, the sprinkler head will discharge the water in slightly different directions from the preceding time.

If it is desired to wet the area in a circular pattern around the sprinkler, the supply of water can be repeatedly turned on and turned off, manually or automatically, since each turn-off of the water will step the sprinkler head 4 one increment of rotation.

It will thus be seen that the sprinkler illustrated in FIGS. 1-3 provides the advantages of a static sprinkler, namely longer range and lower water losses; while at the same time providing the capabilities of a rotary sprinkler of producing a circular (or partially-circular) wetting pattern.

FIGS. 4 and 5 illustrate a sprinkler of the pulsating type constructed in accordance with the invention, in which the pressurized water is applied to the sprinkler head at time-spaced intervals. Each time the supply of water is terminated, the sprinkler head is stepped an increment of rotation so that it discharges the water at a slightly different direction laterly of the sprinkler the next time the water is applied thereto.

More particularly, the sprinkler illustrated in FIG. 4 includes a housing 102, containing a pulsator of the type described in my prior Patent 88014 (U.S. Pat. No. 4,949,747) and a sprinkler head 104 rotatably and reciprocatably mounted to housing 102 in the same manner as described above with respect to the sprinkler of FIGS. 1-3. The pulsator within housing 102 includes a restricted inlet orifice communicating with the sprinkler inlet 106 permitting the water to flow in a coninuous manner, but at a relatively low rate, into the housing 102. The pulsator also includes an outlet port formed with a large orifice communicating with the two nozzles 404*a*, 404*b* of the sprinkler head 104, and an outlet valve (not shown) which opens at a relatively high pressure and closes at a relatively low pressure. The water is thus continuously introduced at a low rate into housing 102, thereby increasing the pressure within the housing, until the outlet valve opens it, at which time the sprinkler head 104 is moved outwardly to its extended position as the valve opens to discharge the water at a high rate via its two nozzles 014*a*, 104B. This discharge continues until the pressure within the housing drops to the predetermined low level value at which time the sprinkler head 104 returns to its normal retracted postion and the valve recloses.

The pulsator device illustrated in FIG. 4 may be the same as described in the above-cited Israel Patent 88014 (U.S. Pat. No. 4,949,747), which description is incorporated herein by reference. Therefore, further details of the construction and operation of the illustrated pulsator device are not set forth herein.

The sprinkler head 104 in the sprinkler of FIGS. 4 and 5 are mounted for rotary and reciprocatable movement with respect to the housing 102 by means of a hollow stem 109 in the same manner as described with respect to the sprinkler of FIGS. 1-3, and similarly carries an indexing mechanism including indexing pawls 120 cooperable with indexing ribs 122 formed in a fixed surface 124 of housing 102. As also in the sprinkler of FIGS. 1–3, indexing pawls 120 are carried at the end of arms 126 pivotally mounted to stem 109 at pivot point 128, and are biased towards the indexing ribs 122 by weights 130 carried by other arms 132 fixed to arms 126 at pivot point 128.

Thus, the sprinkler illustrated in FIGS. 4 and 5 operates in the same manner as described above with respect to FIGS. 1–3. Thus, each time pressurized water is supplied to the sprinkler head 104 by the pulsating device within housing 102, the sprinkler head is moved to its extended position whereby its indexing pawls 120 are raised and pivoted to come into alignment with the next space between the indexing ribs 122; and upon discontinuation of the supply of pressurized water to the sprinkler head by the pulsating device within housing 102, the return of the sprinkler head to its initial retracted position steps itself one increment of rotation around housing 102.

While the invention has been described with respect to two preferred embodiments, it will be appreciated that these are set forth merely for purposes of example, and that many other variations, modifications and applications of the invention may be made.

What is claimed:

1. A rotary sprinkler, comprising:

a housing having an inlet connectable to a source of pressurized water, and an outlet;

a sprinkler head rotatably mounted on said housing about a rotary axis, and connected to said housing outlet to receive pressurized water therefrom and to discharge the water in the form of at least one jet laterally of the sprinker;

said sprinkler head also being mounted on the housing for reciprocation along said rotary axis in one direction, from a normal position to an extended position, by the application of the pressurized water thereto, and in the opposite direction, from the extended position back to the normal position, upon the discontinuation of the pressurized water thereto;

and a stepping mechanism for steppping the sprinkler head an increment of rotation during each reciprocation of the sprinkler head, such that each time the pressurized water is applied to the sprinkler head, it discharges the jet at a slightly different direction laterally of the sprinkler.

2. The rotary sprinkler according to claim 1, wherein said stepping mechanism comprises an indexing pawl carried by said sprinkler head engagable with a circular array of ribs formed in a surface of said housing around said rotary axis to step the sprinkler head each time the sprinkler head moves back to its normal position upon discontinuation of the pressurized water thereto.

3. The rotary sprinkler according to claim 2, wherein said indexing pawl is mounted on a pivotal arm carried by said sprinkler head and biased to align the indexing pawl with another rib of the circular array each time the sprinkler head is moved to its extended position.

4. The rotary sprinkler according to claim 3, wherein said pivotal arm is biased by a weight carried by said pivotal arm.

5. The rotary sprinkler according to claim 2, wherein said pivotal arm is carried by a hollow stem fixed to said sprinkler head and telescopically receivable around a hollow stem fixed to said housing and serving as said housing outlet.

6. The rotary sprinkler according to claim 1, wherein said housing includes a spring for biasing said sprinkler head to its normal position.

7. The rotary sprinkler according to claim 1, wherein said sprinkler head has two diametrically-opposed nozzles for discharging two diametrically-opposed jets laterally of the sprinkler.

8. The rotary sprinkler according to claim 1, wherein said sprinkler is a pop-up sprinkler in which the housing is buried in the ground with the sprinkler head in a normal position substantially at ground level and adapted to pop-up at a level above the ground upon the connection of the sprinkler head to the pressurized water.

9. The rotary sprinkler according to claim 1, wherein said sprinkler is a pulsating type sprinkler which applies pressurized water to the sprinkler head at time-spaced intervals, each application of pressurized water to the sprinkler head moving it to its extended position.

10. A rotary sprinkler, comprising:

a housing having an inlet connectable to a source of pressurized water, and an outlet;

a sprinkler head rotatably mounted on said housing about a rotary axis, and connected to said housing outlet to receive pressurized water therefrom and to discharge the water in the form of at least one jet laterally of the sprinker;

said sprinkler head also being mounted on the housing for reciprocation along said rotary axis in one direction, from a normal position to an extended position, by the application of the pressurized water thereto, and in the opposite direction, from the extended position back to the normal position, upon the discontinuation of the pressurized water thereto;

a spring for biasing said sprinkler head to its normal position;

and a stepping mechanism for steppping the sprinkler head an increment of rotation during each reciprocation of the sprinkler head, such that each time the pressurized water is applied to the sprinkler head, it discharges the jet at a slightly different direction laterally of the sprinkler.

11. The rotary sprinkler according to claim 10, wherein said stepping mechanism comprises an indexing pawl carried by said sprinkler head engagable with a circular array of ribs formed in a surface of said housing around said rotary axis to step the sprinkler head each time the sprinkler head moves back to its normal position upon discontinuation of the pressurized water thereto.

12. The rotary sprinkler according to claim 11, wherein said indexing pawl is mounted on a pivotal arm carried by said sprinkler head and biased to align the indexing pawl with another rib of the circular array each time the sprinkler head is moved to its extended position.

13. The rotary sprinkler according to claim 12, wherein said pivotal arm is biased by a weight carried by said pivotal arm.

14. The rotary sprinkler according to claim 12, wherein said pivotal arm is carried by a hollow stem fixed to said sprinkler head and telescopically receivable around a hollow stem fixed to said housing and serving as said housing outlet.

15. The rotary sprinkler according to claim 10, wherein said sprinkler head has two diametrically-opposed nozzles for discharging two diametrically-opposed jets laterally of the sprinkler.

16. The rotary sprinkler according to claim 10, wherein said sprinkler is a pop-up sprinkler in which the housing is buried in the ground with the sprinkler head in a normal position substantially at ground level and adapted to pop-up at a level above the ground upon the connection of the sprinkler head to the pressurized water.

17. The rotary sprinkler according to claim 10, wherein said sprinkler is a pulsating type sprinkler which applies pressurized water to the sprinkler head at time-spaced intervals, each application of pressurized water to the sprinkler head moving it to its extended position.

* * * * *